US006536614B2

(12) United States Patent
Hsia et al.

(10) Patent No.: US 6,536,614 B2
(45) Date of Patent: Mar. 25, 2003

(54) SHELVES WITH MODULAR PANELS AND ACCESSORIES

(76) Inventors: Chih-Yu Hsia, 301 Warren Way, Arcadia, CA (US) 91007; Quin-Cheng Chen, 115 E. Las Flores Ave., Arcadia, CA (US) 91006

( * ) Notice: Subject to any disclaimer, the term of this patent is extended or adjusted under 35 U.S.C. 154(b) by 1 day.

(21) Appl. No.: 09/905,812

(22) Filed: Jul. 16, 2001

(65) Prior Publication Data

US 2003/0010738 A1 Jan. 16, 2003

(51) Int. Cl.[7] ..... A47B 47/00
(52) U.S. Cl. ..... 211/188
(58) Field of Search ..... 211/194, 186, 211/189; 312/107, 108

(56) References Cited

U.S. PATENT DOCUMENTS

| | | | | | |
|---|---|---|---|---|---|
| 761,103 | A | * | 5/1904 | Richards | 312/108 |
| 3,583,780 | A | * | 6/1971 | Berkowitz | 312/108 |
| 3,644,008 | A | * | 2/1972 | Overby | 312/107 |
| 3,722,704 | A | * | 3/1973 | Piretti | 211/183 |
| 3,807,618 | A | * | 4/1974 | Agerup et al. | 227/148 |
| 6,007,167 | A | * | 12/1999 | Cohen | 206/387.15 |

* cited by examiner

*Primary Examiner*—Alvin Chin-Shue
*Assistant Examiner*—Sarah Purol

(57) ABSTRACT

Shelves made of modular shelves that are composed of four modular panels joined together by fastening means such as screws and bolts and nuts; many variations of the modular panels that form many variations of modular shelves which form many variations of the shelves; back panels and/or momentum blocks optionally providing means to the shelves to resist lateral forces.

40 Claims, 11 Drawing Sheets

SHELVES WITH MODULAR PANELS AND ACCESSORIES

BACKGROUND OF THE INVENTION

1. Field of the Invention

Ordinary self-supported shelves have relatively fixed dimensions and can not be easily expended. Shelves mounted on walls of buildings or structures can not be expanded nor relocated easily. This invention relates to shelves that can be expanded and relocated easily. This invention introduces shelves built with modular shelves that are built with modular panels and accessories. Many variations of the modular panels are introduced. The invention also introduces means and accessories to strengthen a shelf so that it can resist some lateral forces.

2. Descriptions of the Prior Arts

No prior art related to shelves with modular panels and accessories was found.

SUMMARY OF THE INVENTION

Eight variations of the invented device are introduced. Basically, they are shelves made of modular shelves that are composed of four modular panels joined together by fastening means such as screws and bolts and nuts. There are many variations of the modular panels that form many variations of modular shelves. These variations of the modular shelves form many variations of the introduced shelves. A modular shelf can also be made with four modular panels and an additional back panel. This back panel allows the modular shelf to be able to join other modular shelf both horizontally and vertically.

One object of the current inventions is to provide means to build shelves which are easily expandable. The other object of the inventions is to provide means to strengthen a shelf to resist lateral forces. Another object of the inventions is to provide means for a shelf to be able to expend both horizontally and vertically.

These and other objects and advantages of the invention, as well as the details of an illustrative embodiment, will be more fully understood from the following specification and drawings, in which:

DRAWING DESCRIPTION

GENERAL DESCRIPTION

Eight variations of the invented device are introduced herein in this specification.

Figure 2:
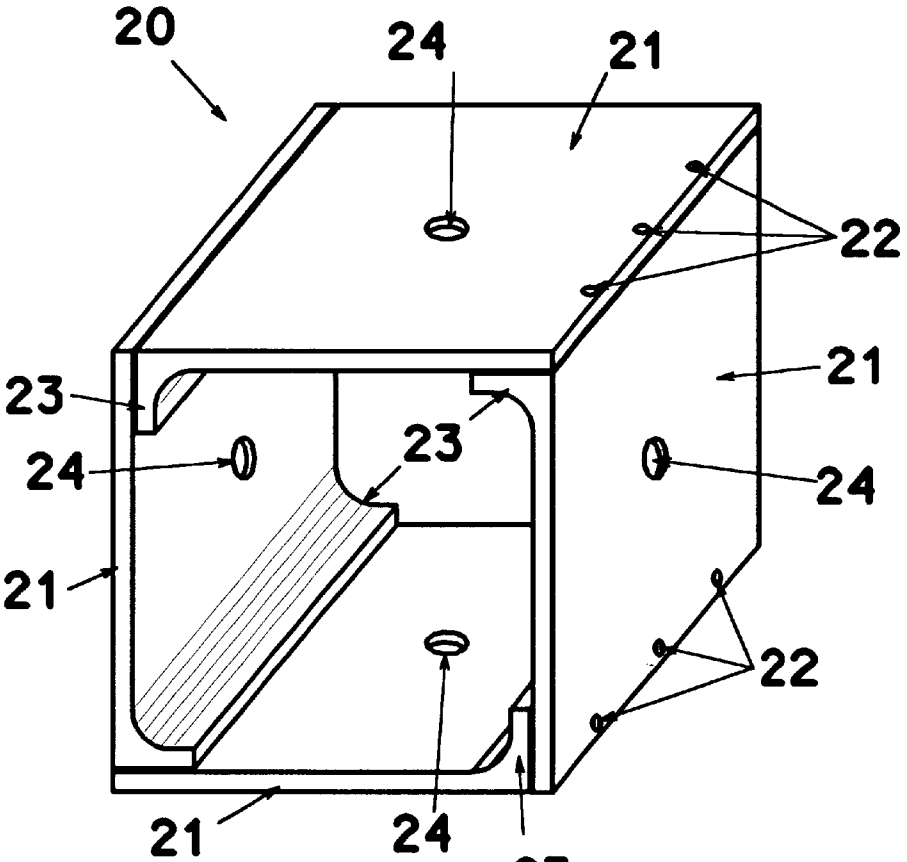
FIG. 2 is an isometric view of a modular shelf of the first variation of the invented device.
Figure 1:
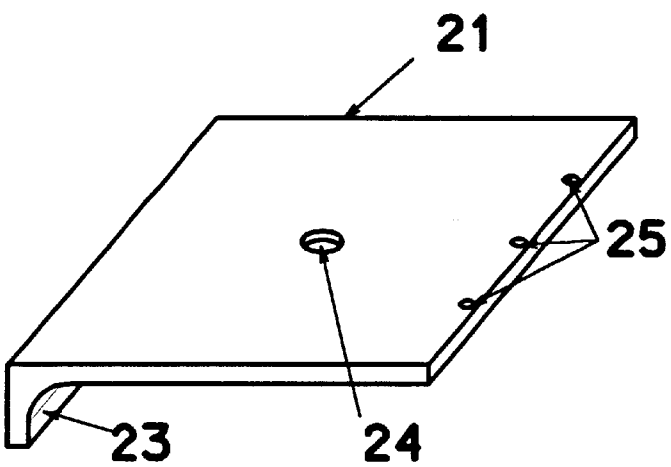
FIG. 1 is an isometric view of a modular panel of the first variation of the invented device.

Referring to FIGS. 1 and 2, the basic unit of the first variation of the invented devices is a modular shelf 20 that consists of four identical modular panels 21 and fastening means 22. Each of the modular panels has an enlarged edge 23 which makes a cross-section of the panel resemble a "L". There is a hole 24 near the center of the modular panel. Along an edge which is opposite to the enlarged edge of the modular panel is a row of holes 25. The fastening means 22 are screws or alike. The fastening means join together the four modular panels to form the box-like modular shelf as shown in FIG. 2.

Figure 3:
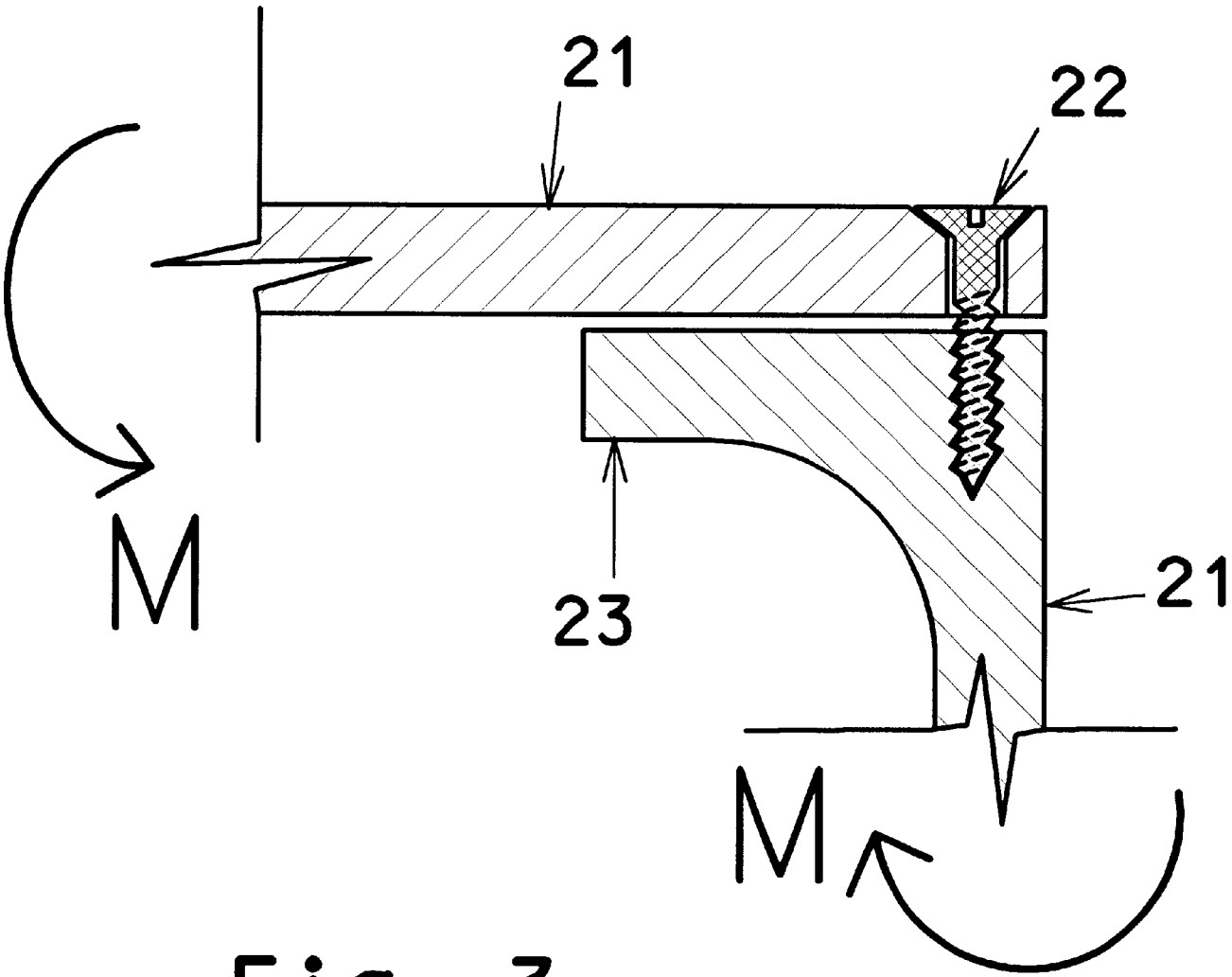
FIG. 3 is a partial sectional view that illustrates how the modular panels of the invented device resist moment forces.

Referring to FIG. 3, the function of the enlarged edge 23 of the modular panel is to form a momentum resistant corner which can provide additional resistance to the momentum forces M. With the four inner corners to have the momentum resistant corners, the modular shelf can resist side forces to form a stable structure to against side forces.

Figure 4:
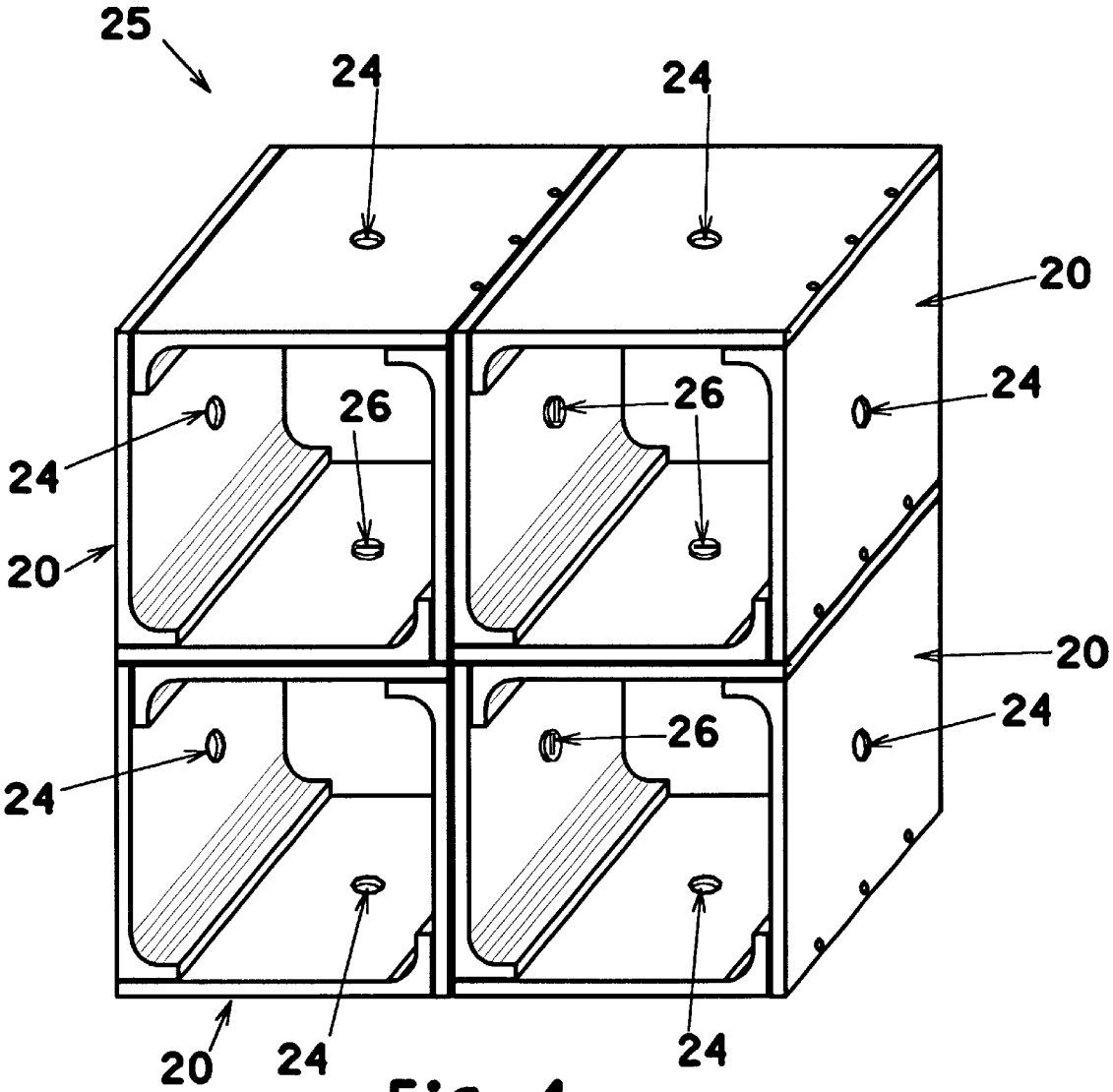
FIG. 4 is an isometric view of a shelf made of four invented modular shelves shown in FIG. 2.

Referring to FIG. 4, a shelf 25 can be formed by joining many modular shelves 20 (four shown in FIG. 4 as an example). The joining is made by using a bolt and nut 26 which penetrates the holes 24 of two adjoining modular panels of two adjoining modular shelves 20 and fastens the two modular shelves. In this way, many modular shelves can be joined together to from a shelf. The shelf can be expanded as needed. The shelf can be disassembled for easy relocations.

Figure 5:
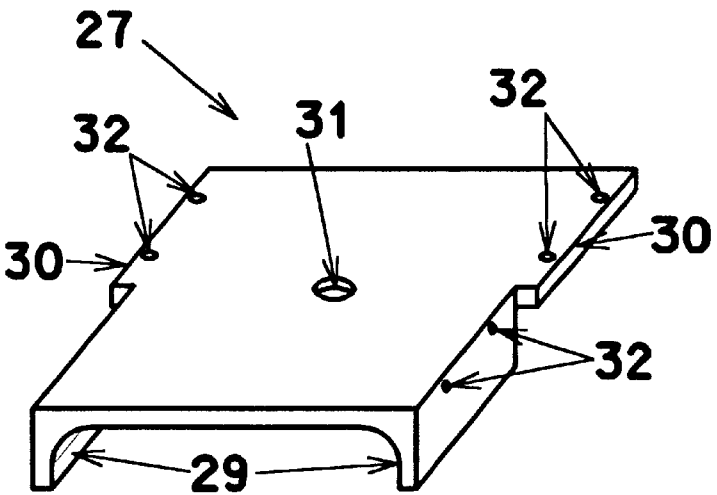
FIG. 5 is an isometric view of a modular panel of the second variation of the invented device.
Figure 6:
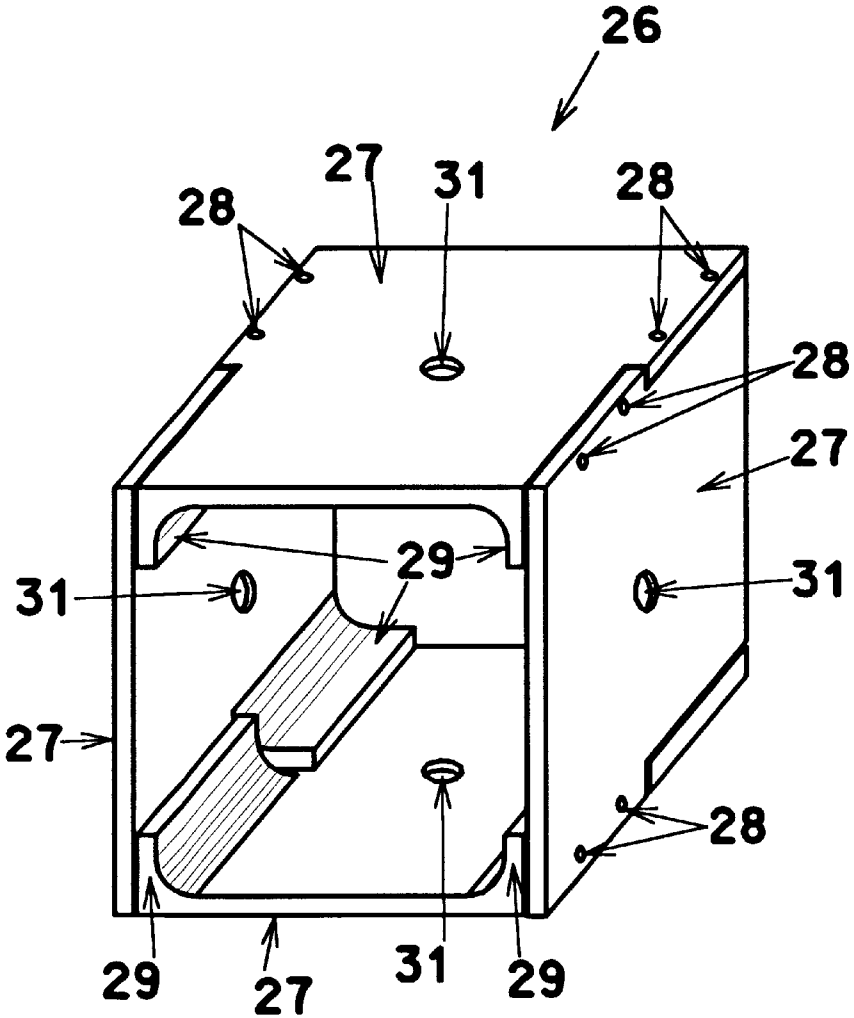
FIG. 6 is an isometric view of a modular shelf of the second variation of the invented device.

Referring to FIGS. 5 and 6, the basic unit of the second variation of the invented devices is a modular shelf 26 that consists of four identical modular panels 27 and fastening means 28. Each of the modular panels has enlarged portions 29 at its two opposite edges 30. The enlarged edges make a cross-section of the panel resemble a "U". There is a hole 31 near the center of the modular panel. There are holes 32 along the portions of the edges which is not enlarged. The fastening means 28 are screws or alike. The fastening means join together the four modular panels to form the box-like modular shelf as shown in FIG. 6. The functions of the enlarged edges are the same as those described for the first variation of the invented devices. More than two of the modular shelves can be joined together to form a shelf, similar to the ways described for the first variation of the invented devices. Therefore no figure is shown for this shelf.

Figure 7:
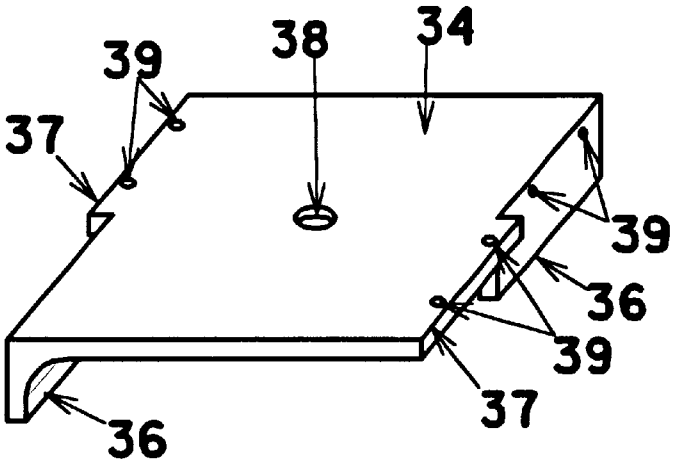
FIG. 7 is an isometric view of a modular panel of the third variation of the invented device.
Figure 8:
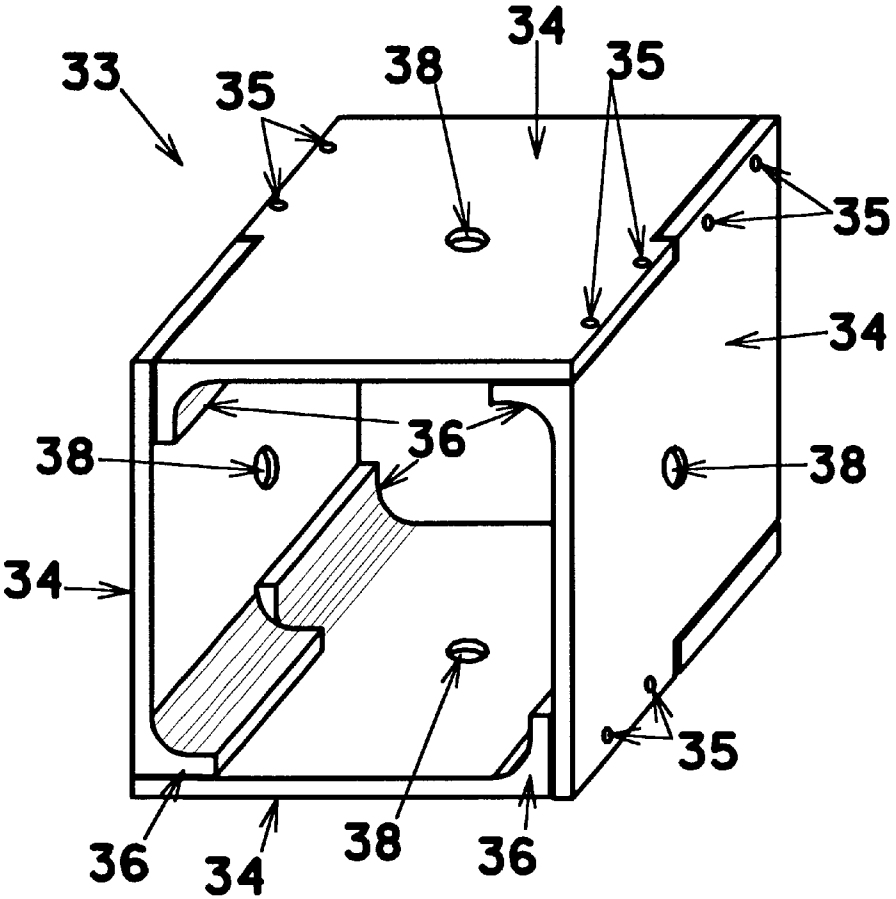
FIG. 8 is an isometric view of a modular shelf of the third variation of the invented device.
Figure 9:
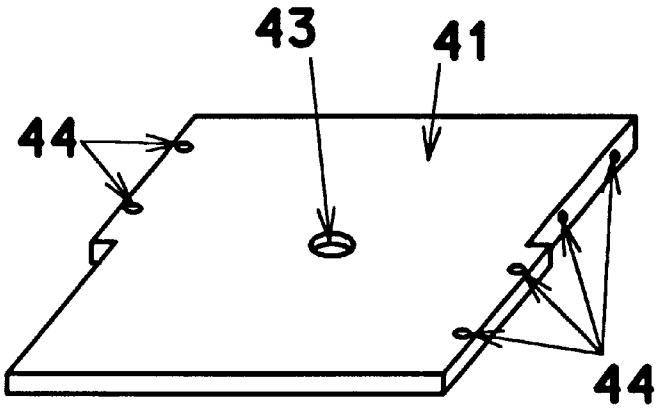
FIG. 9 is an isometric view of a modular panel of the fourth variation of the invented device.
Figure 10:
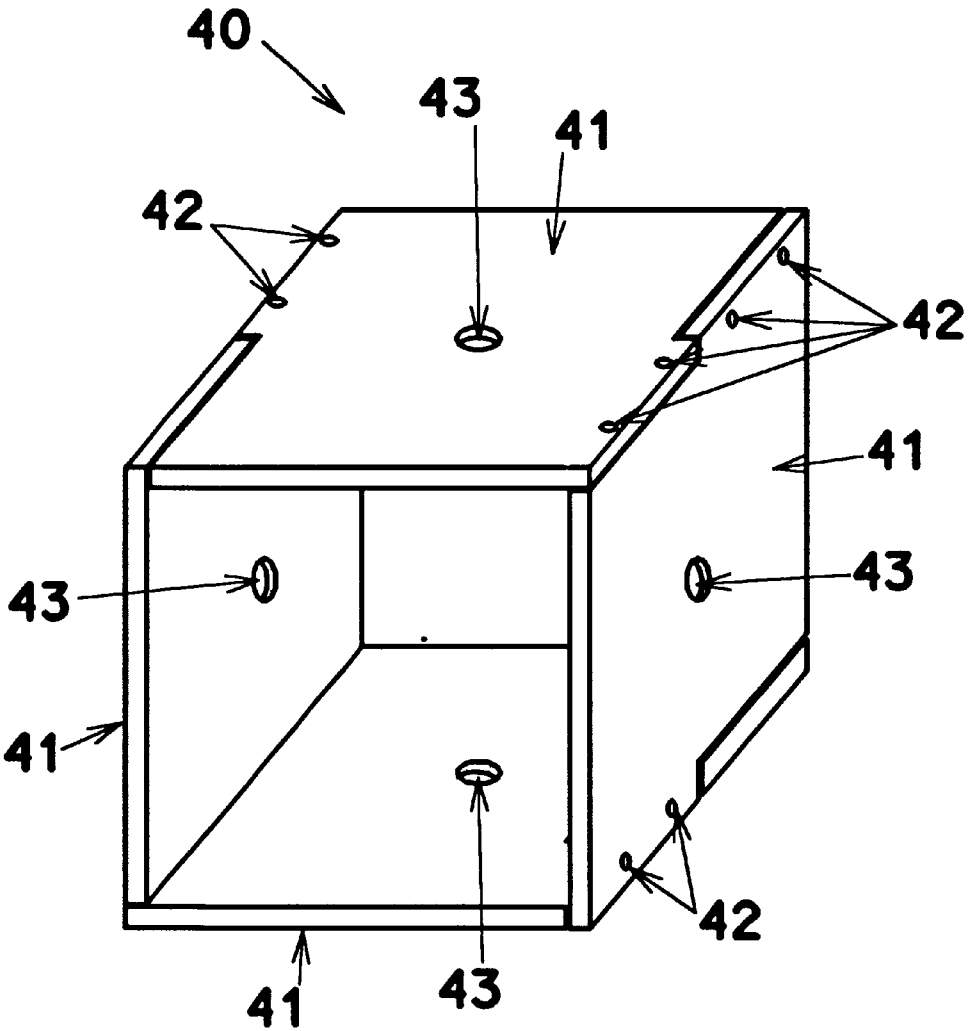
FIG. 10 is an isometric view of a modular shelf of the fourth variation of the invented device.

Referring to FIGS. 7 and 8, the basic unit of the third variation of the invented devices is a modular shelf 33 that consists of four identical modular panels 34 and fastening means 35. Each of the modular panels has enlarged portions 36 of its two opposite edges 37. The enlarged edges make a cross-section of the panel resemble a "L". There is a hole 38 near the center of the modular panel. There are holes 39 along the portions of the edges which is not enlarged. The fastening means 35 are screws or alike. The fastening means join together the four modular panels to form the box-like modular shelf as shown in FIG. 8. The functions of the enlarged edges are the same as those described for the first variation of the invented devices. More than two of the modular shelves can be joined together to form a shelf, similar to the ways described for the first variation of the invented devices. Therefore no figure is shown for this shelf Referring to FIGS. 9 and 10, the basic unit of the fourth variation of the invented devices is a modular shelf 40 that consists of four identical modular panels 41 and fastening means 42. Each of the modular panels is "Z"-shaped. There is a hole 43 near the center of the modular panel. There are holes 44 along two opposite edges of the modular panel. The fastening means 42 are screws or alike. The fastening means join together the four modular panels to form the box-like modular shelf as shown in FIG. 10. More than two of the modular shelves can be joined together to form a shelf, similar to the ways described for the first variation of the invented devices. Therefore no figure is shown for this shelf. The fastening means provides means to resist side forces for a singular modular shelf. When more than two modular shelves are joined together by bolts and nuts through the holes 44, the bolts and nuts and the panels all help to resist momentum forces. Therefore, the shelf can resist forces from sides of the shelf.

Figure 11:
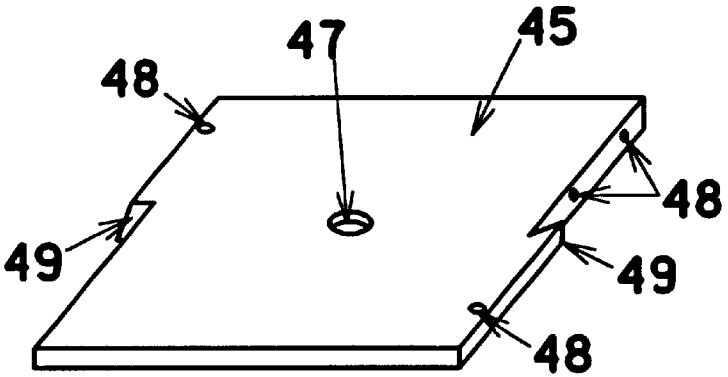
FIG. 11 is an isometric view of a modular panel of the fifth variation of the invented device.
Figure 12:
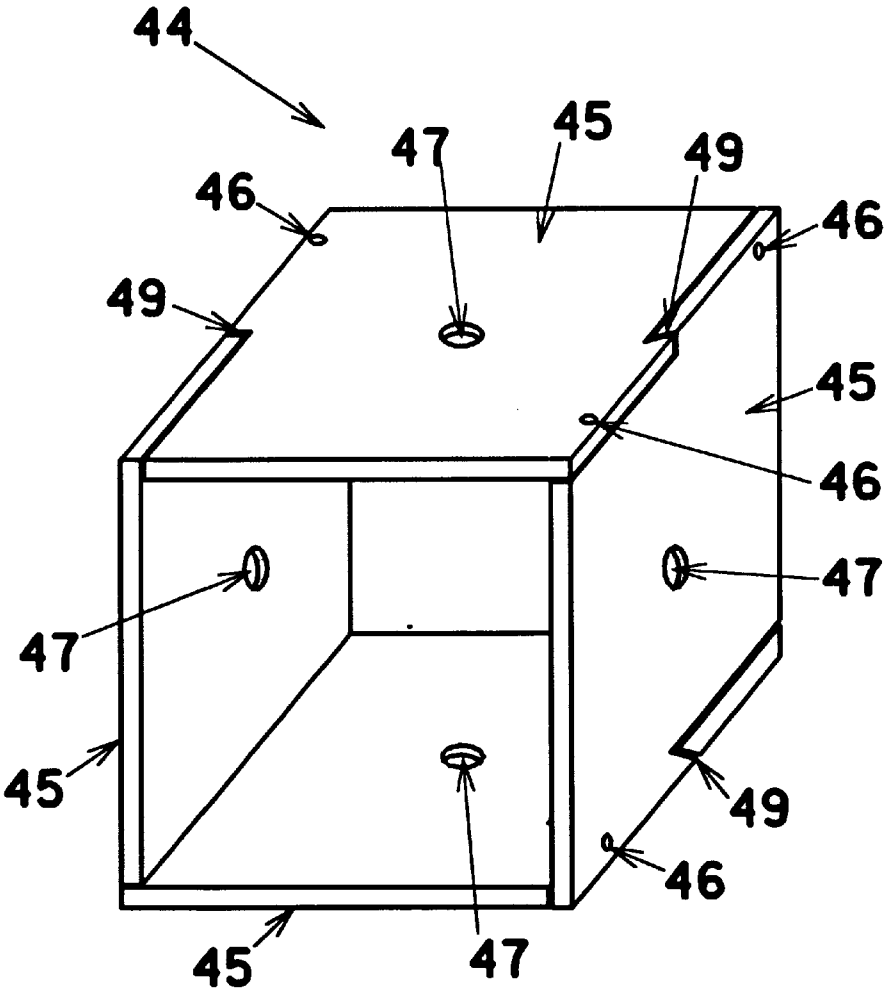
FIG. 12 is an isometric view of a modular shelf of the fifth variation of the invented device.

Referring to FIGS. 11 and 12, the basic unit of the fifth variation of the invented devices is a modular shelf 44 that consists of four identical modular panels 45 and fastening means 46. Each of the modular panels is "Z"-shaped. There is a hole 47 near the center of the modular panel. There are holes 48 along two opposite edges of the modular panel. One end of each of the tips of the legs of the "Z"-shaped panel has a slanted surface 49. The imaginary extensions of the two slanted surfaces are about perpendicular to each other. One slanted surface of a modular panel can engage with a slanted surface of an adjacent modular panel. With the help of the fastening means, this engagement makes the two adjacent panels stay together when joint perpendicularly to each other. The fastening means 46 are screws or alike. The fastening means join together the four modular panels to form the box-like modular shelf as shown in FIG. 12. More than two of the modular shelves can be joined together to form a shelf, similar to the ways described for the first variation of the invented devices. Therefore no figure is shown for this shelf The engagements of the slanted surfaces provide additional resistance to momentum forces for a single modular shelf. When more than two modular shelves are joined together by bolts and nuts through the holes 47, the bolts and nuts and the panels all help to resist momentum forces. The shelf thus can resist forces from its sides.

Figure 13:
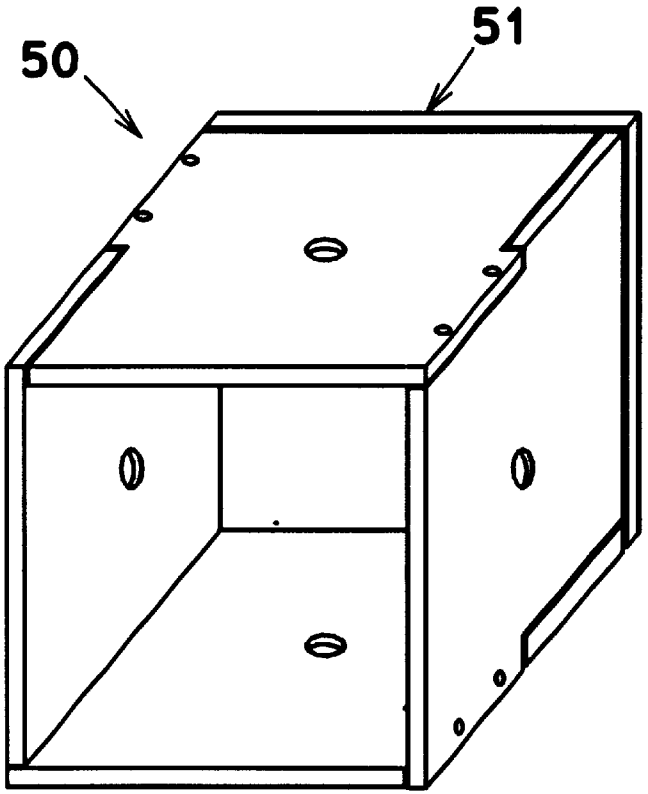
FIG. 13 is an isometric view of a modular shelf of the sixth variation of the invented device.

Referring to FIG. 13, the basic unit of the sixth variation of the invented devices is a modular shelf 50 which is formed by a back panel 51 mounted onto a modular shelf of the fourth variation of the invented devices. The back panel braces the four modular panels so that the modular shelf can resist side forces. More than two of the modular shelves can be joined together to form a shelf, similar to the ways described for the first variation of the invented devices. Therefore no figure is shown for this shelf The back panel may optionally have holes so that it can be joined with a modular panel of an adjacent modular panel of a modular shelf This back panel also provides a mean for a shelf to have it openings opened in different directions. This back panel also allows a shelf to be expanded horizontally.

Figure 14:
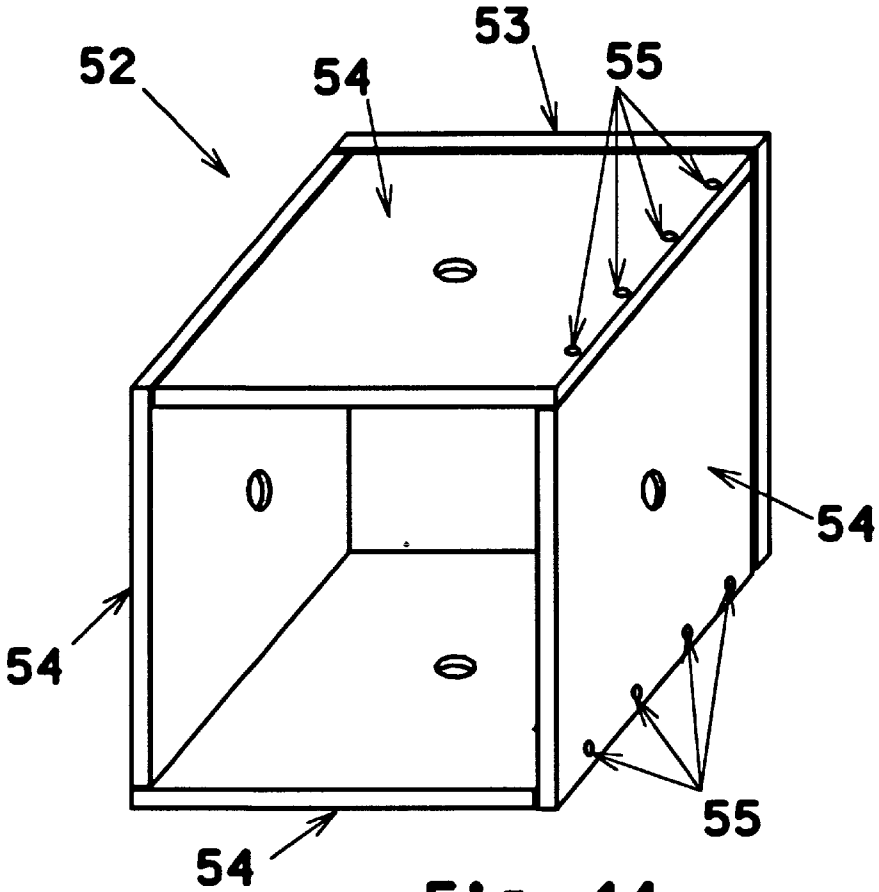
FIG. 14 is an isometric view of a modular shelf of the seventh variation of the invented device.

Referring to FIG. 14, the basic unit of the seventh variation of the invented devices is a modular shelf 52 which is formed by a back panel 53, four identical modular panels 54 and fastening means 55. The fastening means can be screws or alike. The modular panel has a hole near its center and a row of holes on its two opposite edges. The fastening means connect the four modular panels and the back panel together. The back panel braces the four modular panels. The back panel may optionally have holes. The functions of the back panel are the same as those described for the sixth variation of the invented devices. More than two of the modular shelves can be joined together to form a shelf, similar to the ways described for the first variation of the invented devices. Therefore no figure is shown for this shelf.

Figure 15:
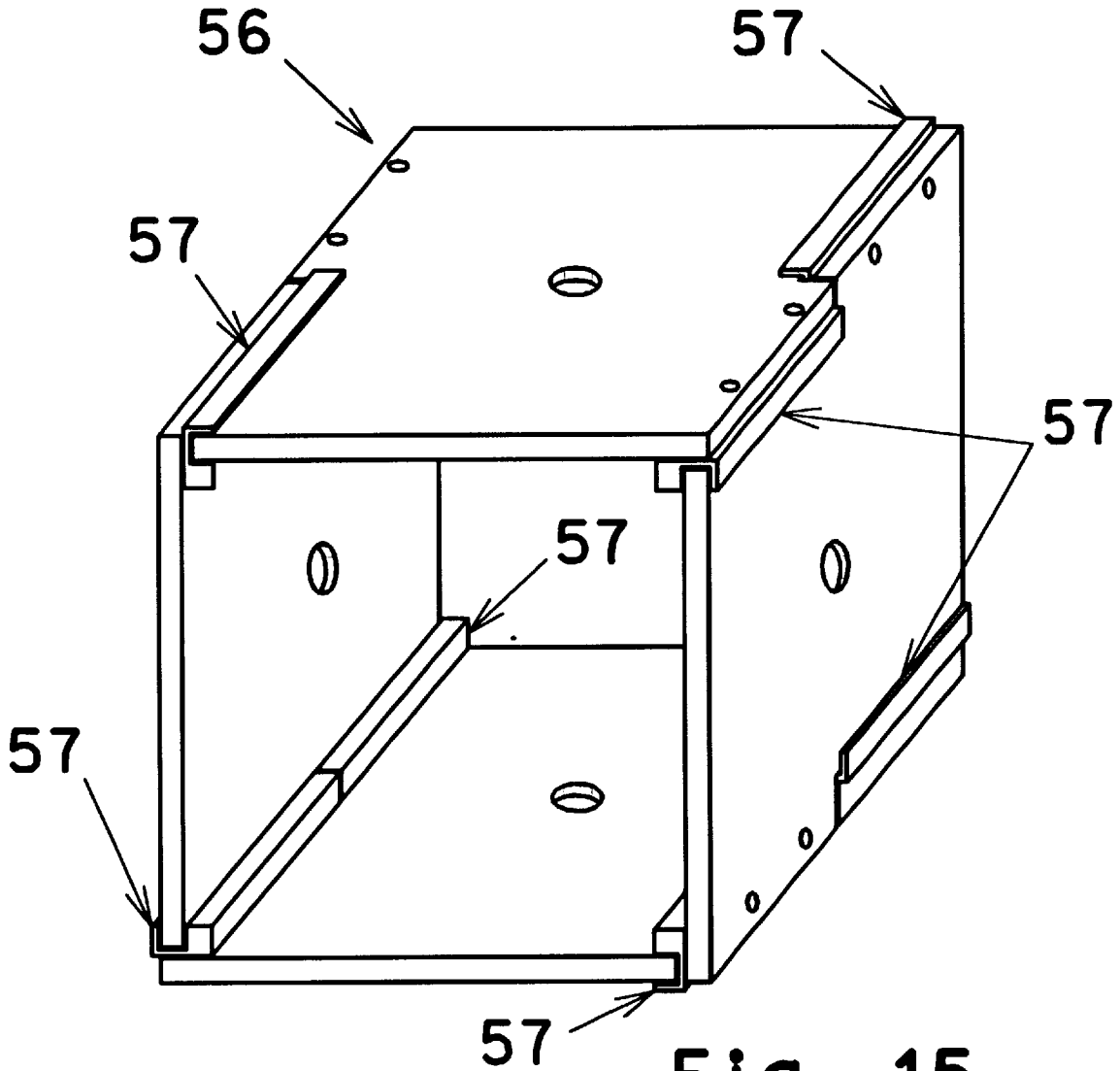
FIG. 15 is an isometric view of a modular shelf of the eighth variation of the invented device.
Figure 16:
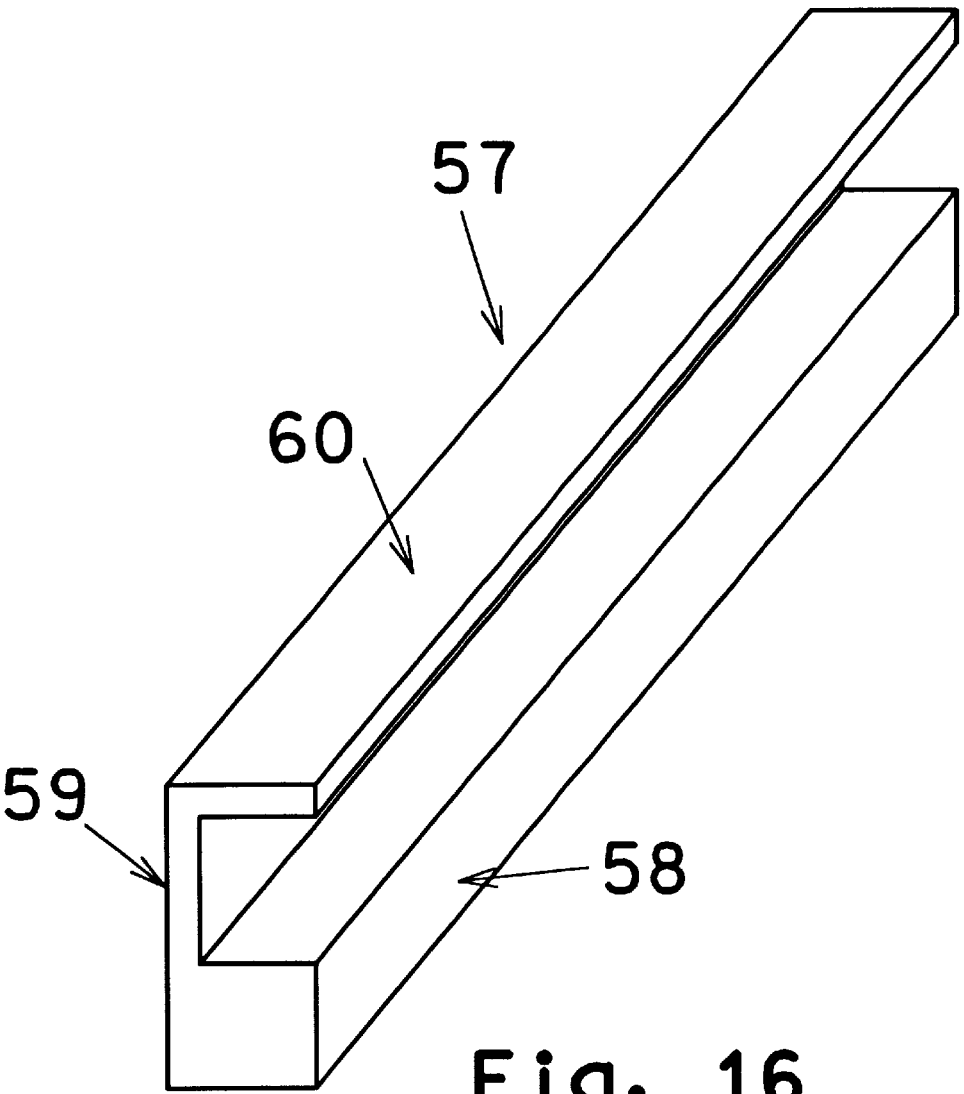
FIG. 16 is an isometric view of a momentum block for the modular shelf shown in FIG. 15.
Figure 17:
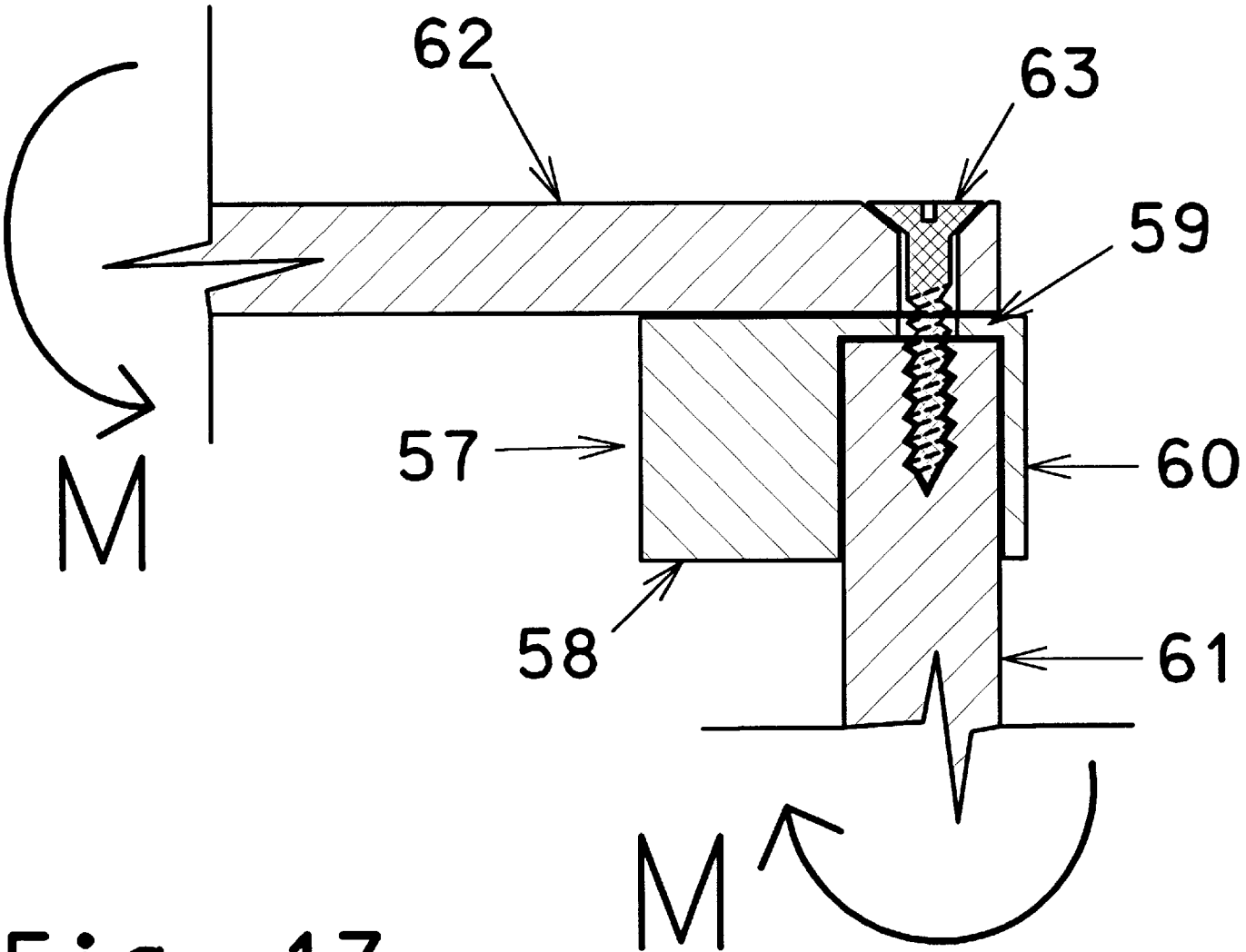
FIG. 17 is a partial sectional view that illustrates the functions of the momentum block for the modular shelf shown in FIG. 15.

Referring to FIG. 15, the basic unit of the eighth variation of the invented devices is a modular shelf 56 which is formed by adding eight momentum blocks 57 onto a modular shelf of the fourth variation of the invented devices. Referring to FIG. 16, the momentum block is a "U"-shaped channel with an enlarged leg 58, a channel web 59, and a thin leg 59. Referring to FIG. 17, the momentum block 57 will be placed on the edge of a modular panel 61 as shown. Then, another modular panel 62 will be fastened perpendicular to the modular panel 61 by the screw 63. The function of the momentum block is to form a momentum resistant corner which can provide additional resistance to the momentum forces M. With the four inner corners to have the momentum blocks, the modular shelf can resist side forces to form a stable structure to against side forces. More than two of the modular shelves can be joined together to form a shelf, similar to the ways described for the first variation of the invented devices. No figure is shown for this shelf.

Although the surfaces of the panels are shown flat in the figures, the surfaces can be not flat and can be wafer surfaces. The panels can have perforations or patterns. The panels may have more than one hole to ensure properly joining of two modular shelves. The edges of the panels can have pre-drilled holes to facilitate the joining of two modular panels by the fastening means. The panel can also have pre-drilled holes so that dowels or alike can be inserted to facilitate the installations of additional shelf or racks in a modular shelf.

The foregoing is considered as illustrative only of the principles of the invention. Furthermore, since numerous modifications and changes will readily occur to those skilled in the art, it is not desired to limit the invention to the exact construction and operation shown and described, and accordingly all suitable modifications and equivalents, may be resorted to, falling within the scope of the invention as claimed.

We claim:

1. A modular shelf made of modular panels comprising:

a) four modular panels;

b) fastening means;

c) each of said four modular panels having an enlarged thickened edge;

d) said fastening means connecting said modular panels and not extending beyond said thickened edge.

2. The modular panel of said four modular panels of said modular shelf of claim 1 wherein said modular panel having a wafer surface.

3. The modular panel of said four modular panels of said modular shelf of claim 1 wherein said modular panel having a hole.

4. The modular panel of said four modular panels of said modular shelf of claim 1 wherein said modular panel having a hole in plural form.

5. The modular panel of said four modular panels of said modular shelf of claim 1 wherein said modular panel having a large hole and two small holes in plural form.

6. A modular shelf made of modular panels comprising:

a) four modular panels;

b) fastening means;

c) each of said four modular panels having enlarged portions of its two opposite edges;

d) said fastening means connecting said modular panels.

7. The modular panel of said four modular panels of said modular shelf of claim 6 wherein said modular panel having a wafer surface.

8. The modular panel of said four modular panels of said modular shelf of claim 6 wherein said modular panel having a hole.

9. The modular panel of said four modular panels of said modular shelf of claim 6 wherein said modular panel having a hole in plural form.

10. The modular panel of said four modular panels of said modular shelf of claim 6 wherein said modular panel having a large hole and two small holes in plural form.

11. A modular shelf made of modular panels comprising:

a) four modular panels;

b) fastening means;

c) each of said four modular panels being "Z"-shaped panel;

d) said fastening means connecting said modular panels.

12. The modular panel of said four modular panels of said modular shelf of claim 11 wherein one end of each of the tips of the legs of said "Z"-shaped panel having a slanted surface.

13. The modular panel of said four modular panels of said modular shelf of claim 11 wherein said modular panel having a hole.

14. The modular panel of said four modular panels of said modular shelf of claim 11 wherein said modular panel having a wafer surface.

15. The modular panel of said four modular panels of said modular shelf of claim 11 wherein said modular panel having a hole in plural form.

16. The modular panel of said four modular panels of said modular shelf of claim 11 wherein said modular panel having a large hole and two small holes in plural form.

17. A modular shelf made of modular panels comprising:

a) four modular panels each having an enlarged thickened edge, b) fastening means;

c) a back panel;

d) said fastening means connecting said modular panels and said back panel and not extending beyond said thickened edge.

18. The modular panel of said four modular panels of said modular shelf of claim 17 wherein said modular panel having a wafer surface.

19. The back panel of said modular shelf of claim 17 wherein said back panel having a wafer surface.

20. The back panel of said modular shelf of claim 17 wherein said back panel having a hole.

21. The back panel of said modular shelf of claim 17 wherein said back panel having a hole in plural form.

22. The back panel of said modular shelf of claim 17 wherein said back panel having a large hole and two small holes in plural form.

23. The modular panel of said four modular panels of said modular shelf of claim 17 wherein said modular panel having a hole.

24. The modular panel of said four modular panels of said modular shelf of claim 17 wherein said modular panel having a hole in plural form.

25. The modular panel of said four modular panels of said modular shelf of claim 17 wherein said modular panel having a large hole and two small holes in plural form.

26. A modular shelf made of modular panels comprising:

a) four modular panels;

b) fastening means;

c) a back panel;

d) each of said four modular panels being "Z"-shaped panel;

e) said fastening means connecting said modular panels and said back panel.

27. The modular panel of said four modular panels of said modular shelf of claim 26 wherein one end of each of the tips of the legs of said "Z"-shaped panel having a slanted surface.

28. The modular panel of said four modular panels of said modular shelf of claim 26 wherein said modular panel having a hole.

29. The modular panel of said four modular panels of said modular shelf of claim 26 wherein said modular panel having a wafer surface.

30. The back panel of said modular shelf of claim 26 wherein said back panel having a wafer surface.

31. The back panel of said modular shelf of claim 26 wherein said back panel having a hole.

32. The back panel of said modular shelf of claim 26 wherein said back panel having a hole in plural form.

33. The back panel of said modular shelf of claim 26 wherein said back panel having a large hole and two small holes in plural form.

34. The modular panel of said four modular panels of said modular shelf of claim 26 wherein said modular panel having a hole in plural form.

35. The modular panel of said four modular panels of said modular shelf of claim 26 wherein said modular panel having a large hole and two small holes in plural form.

36. A shelf comprising:

a) said modular shelf of claim 1 in plural form;

b) fastening means;

c) said fastening means connecting two adjoining said modular shelf of claim 1.

37. A shelf comprising:

a) said modular shelf of claim 6 in plural form;

b) fastening means;

c) said fastening means connecting two adjoining said modular shelf of claim 6.

38. A shelf comprising:

a) said modular shelf of claim 11 in plural form;

b) fastening means;

c) said fastening means connecting two adjoining said modular shelf of claim 11.

39. A shelf comprising:

a) said modular shelf of claim 17 in plural form;

b) fastening means;

c) said fastening means connecting two adjoining said modular shelf of claim 17.

40. A shelf comprising:

a) said modular shelf of claim 26 in plural form;

b) fastening means;

c) said fastening means connecting two adjoining said modular shelf of claim 26.

* * * * *